US005709381A

United States Patent [19]

Hourtash et al.

[11] Patent Number: 5,709,381

[45] Date of Patent: Jan. 20, 1998

[54] PRINTER MEDIA TRAY WITH AUTOMATIC SKEWING OF STACK OF MEDIA

[75] Inventors: Arjang Hourtash; William H. Schwiebert, both of San Diego; Richard Kemplin, Poway; Charles W. Dodge, Escondido, all of Calif.

[73] Assignee: Hewlett-Packard Company, Palo Alto, Calif.

[21] Appl. No.: 755,266

[22] Filed: Nov. 22, 1996

[51] Int. Cl.[6] ..... B65H 1/08

[52] U.S. Cl. ..... 271/147; 271/164; 271/241; 400/624

[58] Field of Search ..... 271/161, 145, 271/171, 126, 147, 164, 241; 400/624

[56] References Cited

U.S. PATENT DOCUMENTS 5,377,969 1/1995 Steinhilber .

*Primary Examiner*—Edgar S. Burr
*Assistant Examiner*—Daniel J. Colilla

[57] ABSTRACT

A paper tray assembly for a computer controlled printer has an angled paper discharge wall and a paper stack skewer which automatically urges the leading edges of each sheet of paper in the stack against the slanted wall as the paper tray is inserted into a tray receiving slot in the printer. The reason for doing this automatic skewing is to prevent paper misfeeds. Optionally, paper length and paper width adjusting slides are used with the automatic paper stack skewer being pivotally affixed to a length adjustment slide, if used. The skewer is operated by interengaging cams and followers which are actuated as the paper tray is inserted into or removed from a tray receiving slot in the printer.

11 Claims, 4 Drawing Sheets

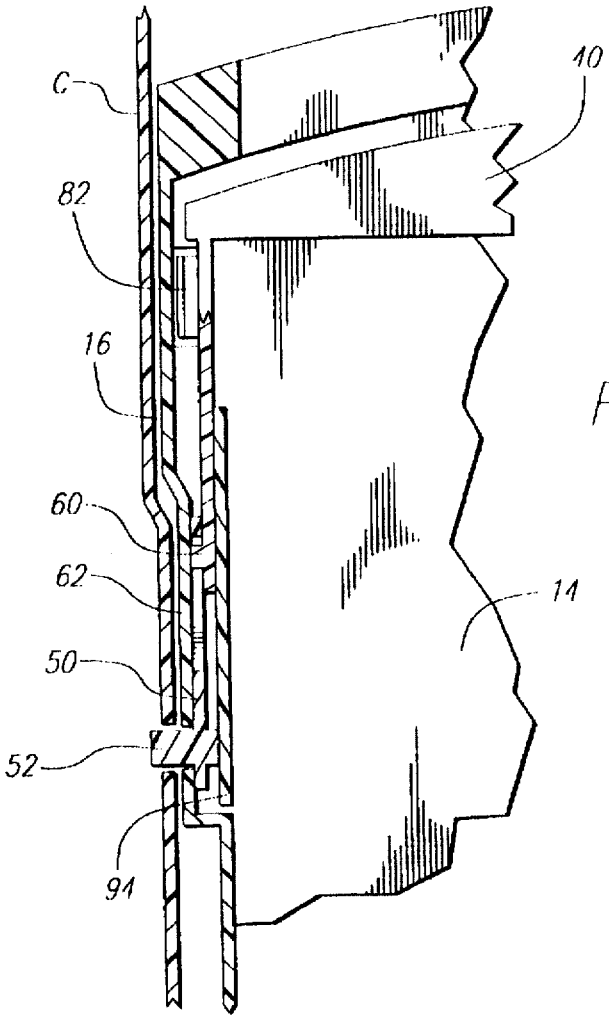
FIG. 4
FIG. 5
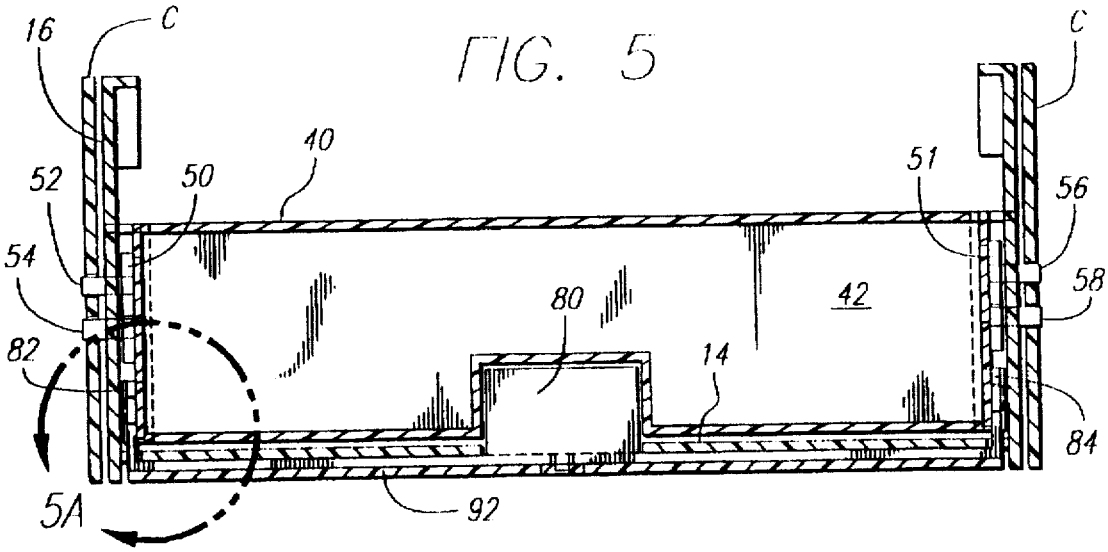

PRINTER MEDIA TRAY WITH AUTOMATIC SKEWING OF STACK OF MEDIA

Cross Reference to Related Applications, if Any

None.

BACKGROUND OF THE INVENTION AND PRIOR ART

1. Field of the Invention

The present invention relates to computer driven printers and, more particularly, to feeding print media sheets of paper or other material, one at a time, from a paper tray to the paper drive mechanism of the printer. For convenience in explanation, instead of the term print media, the term paper will be used herein and is intended to encompass all forms of print media including paper, transparencies, vellum, etc.

2. Description of the Related Art

It is known in the art to use paper trays having a slanted wall at the paper output end which is designed to permit the surface friction of the paper in the tray to be broken with the paper being physically stacked in the tray at an angle as disclosed in U.S. Pat. No. 5,377,969 issued Jan. 3, 1995 to Steinhilber. Paper trays having a slanted paper discharge wall are also disclosed in co-pending application Ser. No. 08/373,829 filed Jan. 17, 1995 by Gustafson and in Ser. No. 08/398,033 filed Mar. 3, 1995 by Gustafson, et al and owned by the assignee of the present invention. Trays of this type are used in printers which employ an articulated paper pusher arm mounted in either the paper tray or the printer housing which urges the top sheet of the paper in the tray toward the slanted paper discharge wall of the tray and then to the printer paper feed mechanism.

Although paper trays having a slanted rear wall are known, proper positioning of the paper in the paper trays such that the leading edge of the stack of paper is skewed into engagement with the slanted wall of the paper tray has previously been accomplished manually. In order to replenish the supply of paper in the tray, the tray is removed from the printer and the operator physically places a stack of paper therein and manually fans or skews the paper against the slanted rear wall of the tray while generally trying to ensure contact between the leading edges of each sheet of paper and the slanted rear wall of the tray. This is not always totally always accomplished with the result being occasional misfeeds of paper. Either the paper pusher is unable to break the surface friction between two adjacent unskewed sheets of paper resulting in no feed or multiple sheets of paper may occasionally be fed if the surface tension therebetween has not been broken or minimized by proper skewing.

It is accordingly the primary objective of the present invention to provide an automatic means for skewing of paper to engage the leading edges of paper sheets in a stack with the slanted rear wall of a paper tray.

SUMMARY OF THE INVENTION

The present invention accordingly provides a paper tray assembly for a computer controlled printer, said assembly comprising:

a) a paper tray having a generally flat bottom wall, a pair of generally vertical side walls and a paper discharge wall extending upwardly from said bottom wall, said discharge wall being inclined in the direction of paper movement and a cam track being provided in at least one of said side walls;

b) a paper stack skewer mounted on said paper tray proximate a paper loading end thereof, said stack skewer comprising a paper engaging wall pivotally affixed in said paper tray such that said paper engaging wall is moveable between a substantially vertical paper loading position and an inclined paper skewing position parallel to said paper discharge wall;

c) at least one stack skewer actuator slide mounted proximate at least one side wall of said tray, said slide and said stack skewer having interengaging means thereon to pivotally move said stack skewer between said positions, said slide further including cam follower means thereon which engage said cam track in said at least one paper tray side wall and for engaging at least one cam track means on the printer chassis to translate said slide vertically relative to said at least one side wall whereby said interengaging means pivotally move said skewer from said paper loading position to said paper skewing position as said paper tray is inserted into a tray receiving slot in a printer and for moving said skewer from said paper skewing position to said paper loading position as said paper tray is withdrawn from said slot in said printer.

The present invention further provides a computer controlled printer comprising:

a) a chassis having a printing mechanism and a slot for receiving a paper tray;

b) a paper tray having a generally flat bottom wall, a pair of generally vertical side walls and a paper discharge wall extending upwardly from said bottom wall, said discharge wall being inclined in the direction of paper movement and a cam track being provided in at least one of said side walls;

c) a paper stack skewer mounted on said paper tray proximate a paper loading end thereof, said stack skewer comprising a paper engaging wall pivotally affixed in said paper tray such that said paper engaging wall is moveable between a substantially vertical paper loading position and an inclined paper skewing position parallel to said paper discharge wall;

d) at least one stack skewer actuator slide mounted proximate at least one side wall of said tray, said slide and said stack skewer having interengaging means thereon to pivotally move said stack skewer between said positions, said slide further including cam follower means thereon which engage said cam track in said at least one paper tray side wall and for engaging at least one cam track means on the printer chassis to translate said slide substantially vertically relative to said at least one side wall whereby said interengaging means pivotally move said skewer from said paper loading position to said paper skewing position as said paper tray is inserted into said tray receiving slot in a printer and for moving said skewer from said paper skewing position to said paper loading position as said paper tray is withdrawn from said slot in said printer.

BRIEF DESCRIPTION OF THE DRAWINGS

FIG. 4 is a partial sectional top plan view of the paper tray and stack skewer of FIG. 1 taken at line 4—4 on FIG. 2.

FIG. 5 is a front elevation view, partly in cross-section taken at line 5—5 on FIG. 2 of the paper tray and stack skewer of FIG. 1.

DESCRIPTION OF THE PREFERRED EMBODIMENTS

Figure 1:
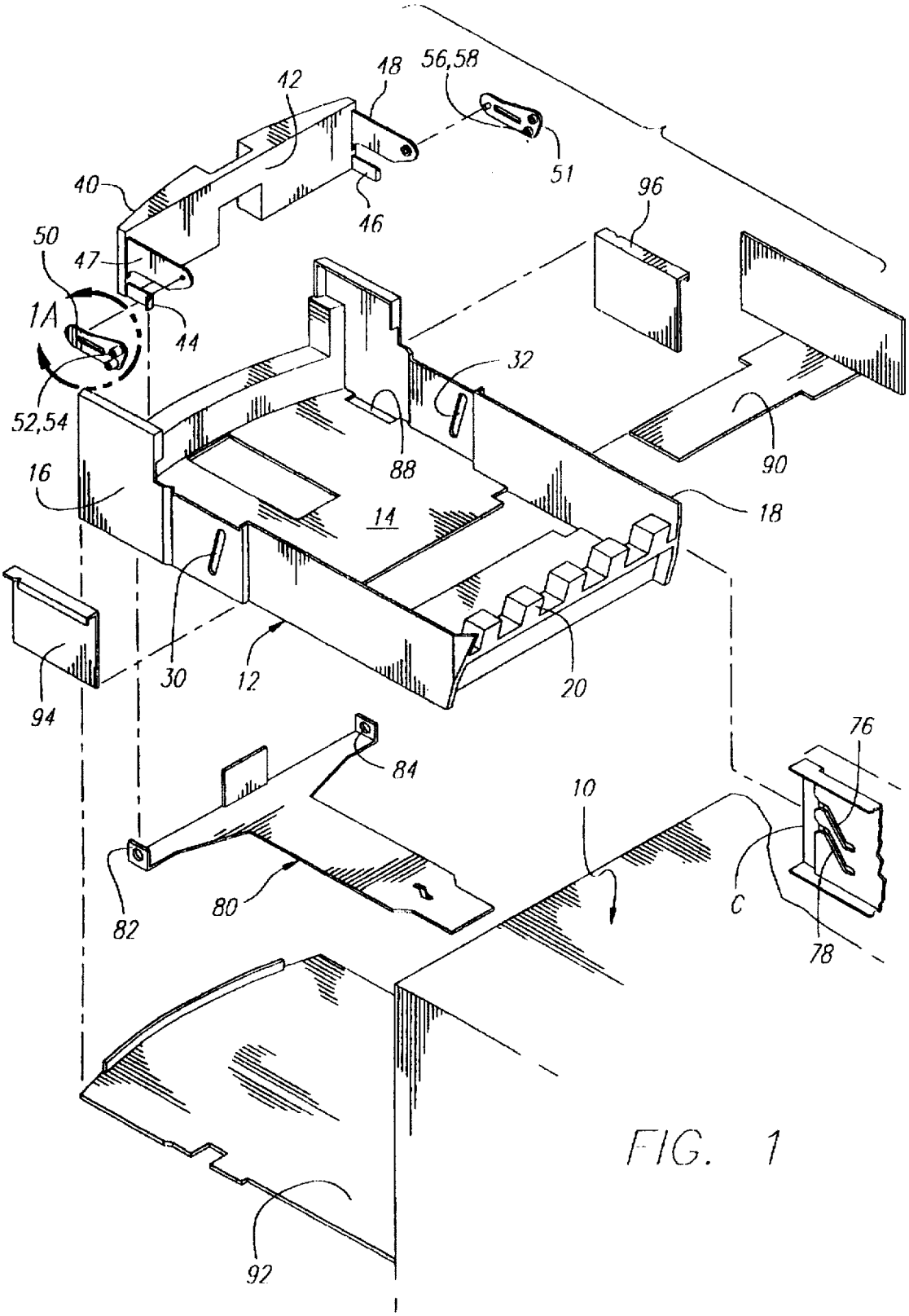
FIG. 1 is an exploded perspective view, partly broken away, of a printer paper tray and automatic paper stack skewer constructed according to the teachings of the present invention, FIG. 1A being an enlarged detail.

As seen in the exploded perspective view of FIG. 1, a computer printer 10 receives a paper tray assembly comprised of a paper tray 12 preferably molded of a single piece of plastic having a generally flat bottom wall 14, a pair of generally vertically extending side walls 16, 18 and an angled paper discharge wall 20 which is inclined in the direction of paper movement. Elongated cam track openings 30, 32 are provided in each of the side walls, these cam tracks 30, 32 extending in a substantially vertical direction as shown.

Figure 2:
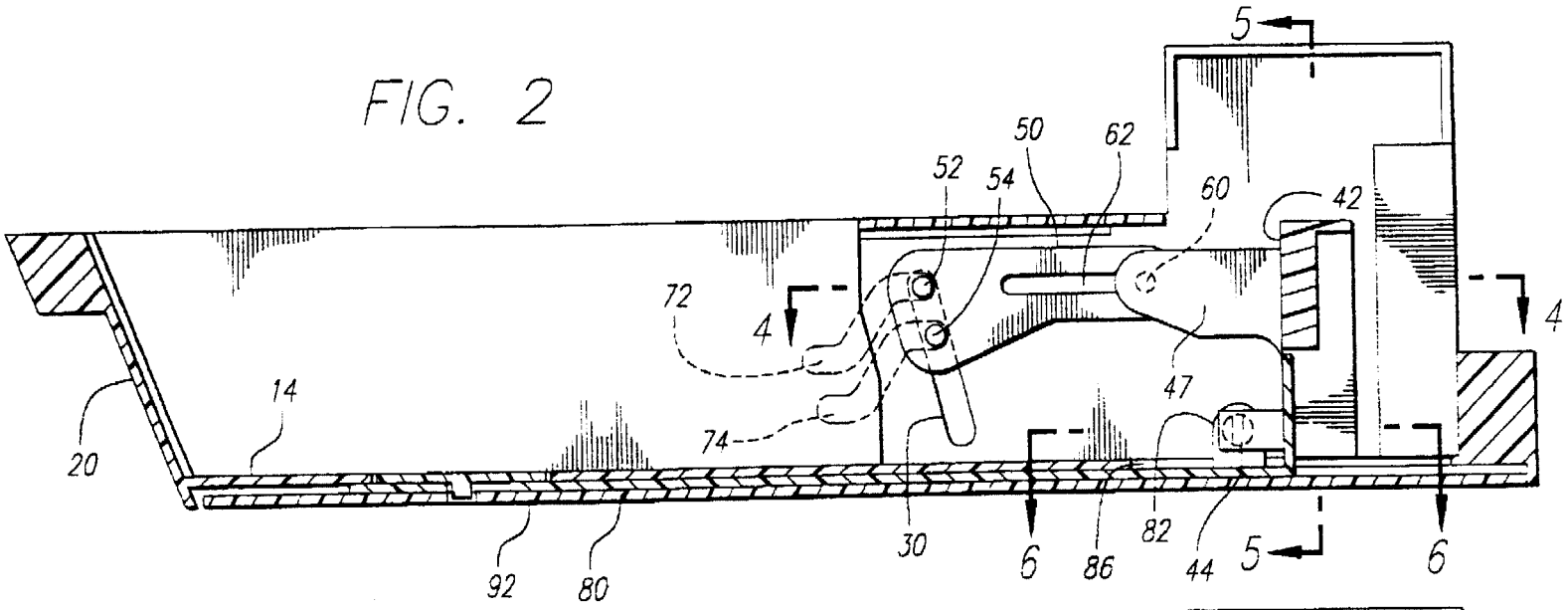
FIG. 2 is a side elevation in cross section of the paper tray and stack skewer of FIG. 1 in a paper loading position.
Figure 3:
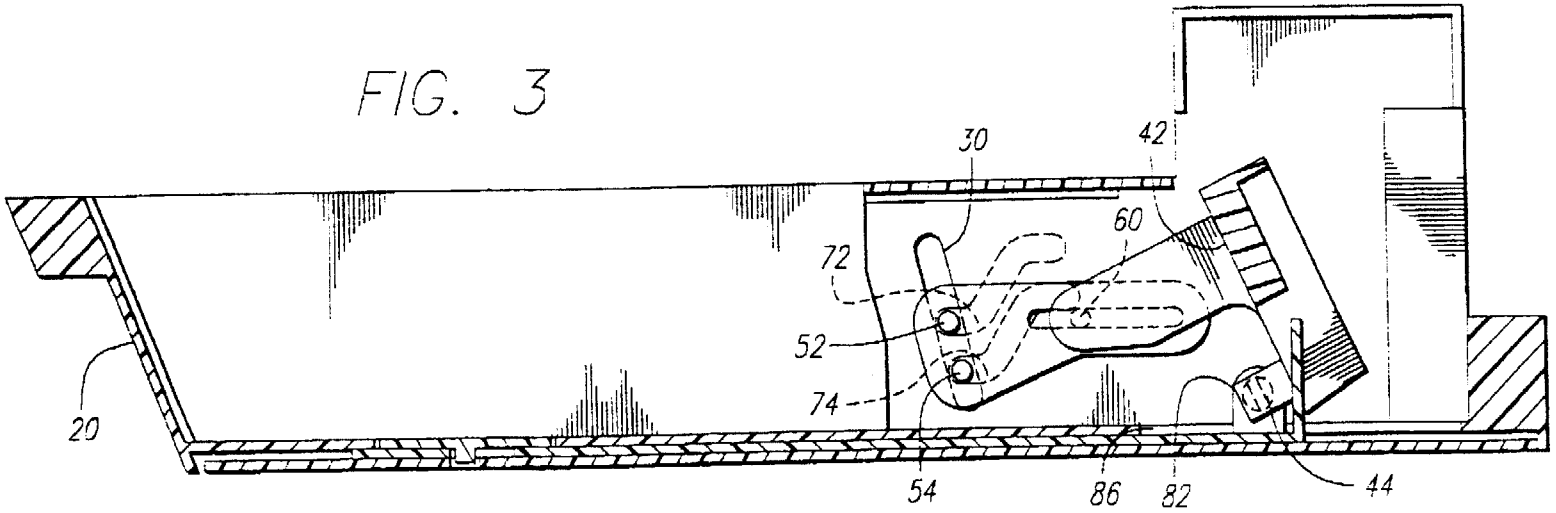
FIG. 3 is a side elevation in cross section of the paper tray and stack skewer of FIG. 1 in a paper skewed position.

In order to skew paper loaded into the tray such that the leading edges of each sheet of paper do not occupy the same vertical plane, a paper stack skewer 40 is pivotally mounted in the paper tray 12 proximate the paper loading end. The stack skewer 40 comprises a paper engaging wall 42 which is moveable between a substantially vertical paper loading position as seen in FIG. 2 and an inclined paper skewing position as seen in FIG. 3 in which the paper engaging wall 42 is parallel to the paper discharge wall 20. The paper skewer 40 can be pivotally affixed directly to the paper tray 12 or, as will be described below, it can be connected to a paper length adjustment slide 80 to be described below, which is part of the paper tray assembly. For this purpose, the skewer 40 has a pair of horizontally extending support arms 44, 46 which are pivotally connected to the paper tray assembly. As the paper skewer 40 rotates around the pivot points of support arms 44, 46 form a vertical position to the paper skewing position, the trailing edge of the paper stack is lifted to assist paper skewing.

The skewer 40 also has at least one and preferably two actuator arms 47, 48 affixed to the paper engaging wall 42 for moving the skewer 40 between positions seen in FIGS. 2 and 3. At least one and preferably two stacked skewer actuator slides 50, 51 are positioned between actuator arms 47, 48 and the proximate side walls 16, 18 of the paper tray. In the preferred embodiment, each actuator arm 47, 48 has a horizontally extending boss 60 thereon which is received in a horizontally extending slot or groove 62 in the actuator slide to afford an adjustment for differing lengths of paper in the tray.

Figure 1A:
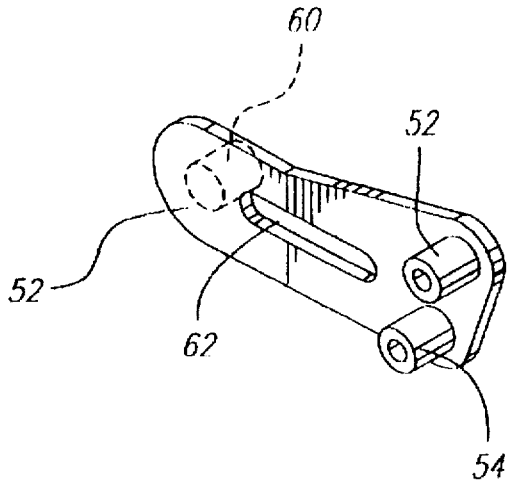

The purpose of the actuator slides 50, 51 is to automatically tilt the paper skewer as the paper tray is inserted into the receiving slot of the printer. Accordingly, the stack skewer actuator slides 50, 51 each include a pair of cam followers 52, 54 (FIG. 1A); 56, 58 thereon which extend through and follow the cam tracks 30, 32 in the side walls of the paper tray and which have a length sufficient to be received in generally S-configured cam tracks 72, 74; 76, 78 on the printer chassis C. Thus, as the paper tray 12 is moved into the printer, followers 52, 54; 56, 58 follow their associated cam tracks 72, 74; 76, 78 to move first horizontally then downwardly and finally horizontally such that the stack skewer 40 is pivotally moved from the paper loading position in FIG. 2 to the paper skewing position seen in FIG. 3.

Figure 6:
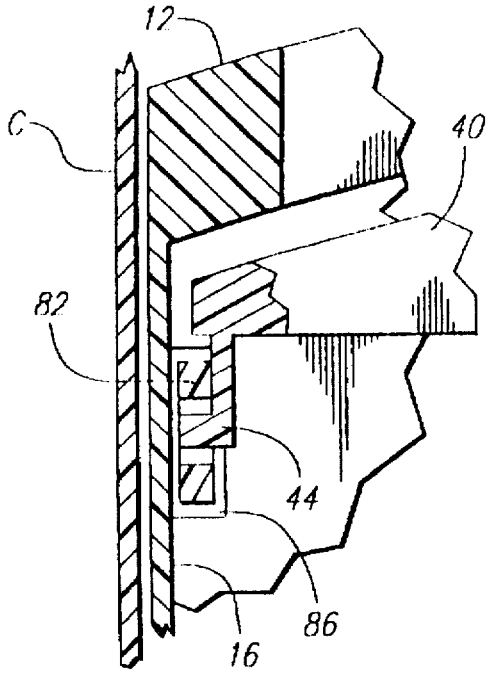
FIG. 6 is an enlarged cross-section plan view, taken at line 6—6 on FIG. 2, of the connection of the stack skewer actuator slide to a paper tray length adjustment slide.
Figure 5A:
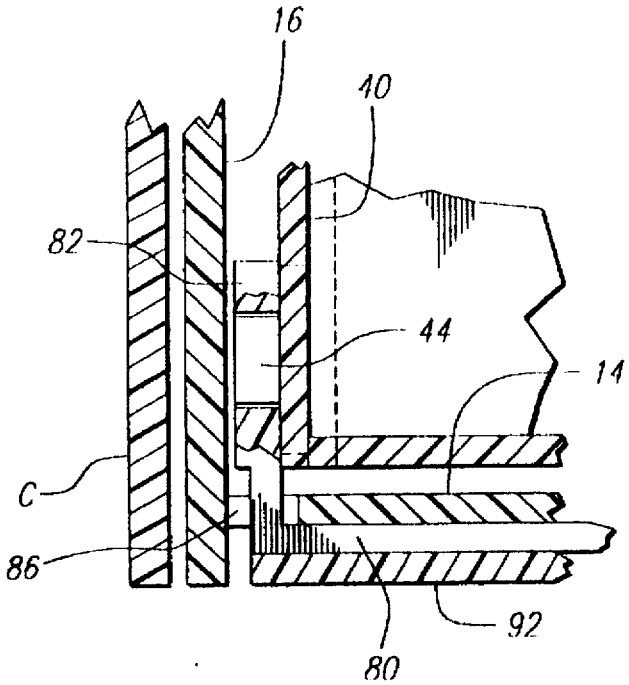
FIG. 5*a* is a view, to an enlarged scale, of the corner portion of the paper tray and stack skewer indicated in FIG. 5.

Although not essential, some paper tray assemblies include paper length and paper width adjustment slides so that separate trays sized to handle different paper sizes are not required. In the preferred embodiment, a paper length adjustment slide 80 is provided which is movable horizontally beneath the bottom Wall 14 of the paper tray. The paper length adjustment slide 80 has upstanding ears 82, 84 at opposite sides thereof which extend upwardly through corresponding openings 86, 88 in the bottom wall 14 of the paper tray. The upstanding ears 82, 84 are pivotally connected to the support arms 44, 46 of the paper skewer 40 as best seen in FIGS. 5 and 6.

Similarly, a paper width adjustment slide 90 can be provided. The details of the paper width adjustment slide 90 are not described since it is not considered essential to the present invention. The paper length and width adjustment slides 80, 90 are each disposed beneath the bottom wall 14 of the paper tray in a pocket defined between the bottom wall 14 and a bottom cover 92 affixed to the paper tray preferably by bayonet type connections.

Optionally, a pair of side wall covers 94, 96 may be provided to define, with the paper tray side walls 16, 18, receiving pockets which completely enclose a stacked skewer actuator slide 50, 51 and their interengaging connections with the skewer actuator arms 47, 48.

Persons skilled in the art will readily appreciate that various modifications can be made from the preferred embodiment of the invention disclosed herein and that the scope of protection is intended to be defined only by the limitations of the appended claims.

We claim:

1. A paper tray assembly for a computer controlled printer, said assembly comprising:

a) a paper tray having a generally flat bottom wall, a pair of generally vertical side walls and a paper discharge wall extending upwardly from said bottom wall, said discharge wall being inclined in the direction of paper movement and a cam track being provided in at least one of said side walls;

b) a paper stack skewer mounted on said paper tray proximate a paper loading end thereof, said stack skewer comprising a paper engaging wall pivotally affixed in said paper tray such that said paper engaging wall is moveable between a substantially vertical paper loading position and an inclined paper skewing position parallel to said paper discharge wall;

c) at least one stack skewer actuator slide mounted proximate at least one side wall of said tray, said slide and said stack skewer having interengaging means thereon to pivotally move said stack skewer between said positions, said slide further including cam follower means thereon which engage said cam track in said at least one paper tray side wall and for engaging at least one cam track means on a printer chassis to translate said slide vertically relative to said at least one side wall whereby said interengaging means pivotally move said skewer from said paper loading position to said paper skewing position as said paper tray is inserted into a tray receiving slot in a printer and for moving said skewer from said paper skewing position to said paper loading position as said paper tray is withdrawn from said slot in said printer.

2. The paper tray assembly of claim 1, wherein said cam track in said at least one side wall is an elongated track extending substantially vertically.

3. The paper tray assembly of claim 2, further comprising a paper length adjustment slide, said skewer being pivotally mounted to said paper length adjustment slide.

4. The paper tray assembly of claim 3, further comprising a bottom cover affixed to said tray beneath and spaced from said bottom wall to define a pocket for substantially enclosing said paper length adjustment slide, and wherein said paper adjustment slide is located in said pocket and has a pair of vertically extending ears, said tray having openings in said bottom wall for receiving said ears, said stack skewer being pivotally affixed to each of said ears.

5. The paper tray assembly of claim 4, wherein said interengaging means on slide and stack skewer comprise an elongate slot or groove in said slide and a boss on said skewer which moves in said slot or groove.

6. The paper tray assembly of claim 5, further comprising a second said stack skewer actuator slide and cam follower means thereon proximate a second side wall of said tray, said second side wall having a cam track therein extending substantially vertically.

7. The paper tray assembly of claim 6, wherein said tray side walls include pockets for receiving said stack actuator skewer slides and said interengaging means to prevent paper in said tray from contact with said slides or said interengaging means.

8. A computer controlled printer comprising:

a) a chassis having a printing mechanism and a slot for receiving a paper tray;

b) a paper tray having a generally flat bottom wall, a pair of generally vertical side walls and a paper discharge wall extending upwardly from said bottom wall, said discharge wall being inclined in the direction of paper movement and a cam track being provided in at least one of said side walls;

c) a paper stack skewer mounted on said paper tray proximate a paper loading end thereof, said stack skewer comprising a paper engaging wall pivotally affixed in said paper tray such that said paper engaging wall is moveable between a substantially vertical paper loading position and an inclined paper skewing position parallel to said paper discharge wall;

d) at least one stack skewer actuator slide mounted proximate at least one side wall of said tray, said slide and said stack skewer having interengaging means thereon to pivotally move said stack skewer between said positions, said slide further including cam follower means thereon which engage said cam track in said at least one paper tray side wall and for engaging at least one cam track means on the printer chassis to translate said slide substantially vertically relative to said at least one side wall whereby said interengaging means pivotally move said skewer from said paper loading position to said paper skewing position as said paper tray is inserted into said tray receiving slot in said printer and for moving said skewer from said paper skewing position to said paper loading position as said paper tray is withdrawn from said slot in said printer.

9. The printer of claim 8, wherein said cam track means on said printer chassis have an elongate S-configuration.

10. The printer of claim 9, wherein said cam track means on said printer chassis comprise a pair of parallel vertically spaced S-configured tracks, said tracks each receiving a cam follower on said skewer actuator slide.

11. The printer of claim 10, wherein the vertical and horizontal extent of said S-configured tracks is substantially the same as the vertical and horizontal components of said cam track in said at least one side wall.

* * * * *